United States Patent [19]

Muller

[11] Patent Number: 4,941,422

[45] Date of Patent: Jul. 17, 1990

[54] HATCH VENTILATOR AWNING FOR BOATS

[76] Inventor: Marshall K. Muller, 969 Mayo Rd., Edgewater, Md. 21037

[21] Appl. No.: 356,769

[22] Filed: May 25, 1989

[51] Int. Cl.[5] ..... B63B 19/28

[52] U.S. Cl. ..... 114/203; 114/201 R; 135/88; 135/104

[58] Field of Search ..... 114/201 R, 203, 173, 114/177, 178, 343, 361; 135/88, 90, 104, 102, 105; 160/56, 76

[56] References Cited

U.S. PATENT DOCUMENTS

| | | | |
|---|---|---|---|
| D. 192,540 | 4/1962 | Barnard . | |
| 2,453,422 | 11/1948 | Ellsworth | 135/6 |
| 2,513,764 | 7/1950 | Vander Ahe | 135/6 |
| 3,051,967 | 9/1962 | Beach | 9/1 |
| 3,354,892 | 7/1967 | Frieder | 135/6 |
| 3,367,349 | 2/1968 | O'Link | 135/6 |
| 4,091,484 | 5/1978 | Means | 9/1.5 |
| 4,200,115 | 4/1980 | Parker | 135/88 |
| 4,455,958 | 1/1984 | O'Rourke et al. | 114/40 |
| 4,582,016 | 4/1986 | Hansen | 114/361 |
| 4,593,641 | 7/1986 | Adams | 114/361 |
| 4,671,203 | 6/1987 | Sanburg | 114/361 |
| 4,683,900 | 8/1987 | Carmichael | 135/88 |
| 4,719,934 | 1/1988 | Mydans | 135/102 |
| 4,739,784 | 4/1988 | Fast | 135/102 |

FOREIGN PATENT DOCUMENTS

| | | | |
|---|---|---|---|
| 933420 | 9/1973 | Canada | 114/203 |
| 536699 | 10/1931 | Fed. Rep. of Germany | 114/203 |
| 823723 | 9/1959 | Fed. Rep. of Germany | 114/203 |
| 2348796 | 4/1975 | Fed. Rep. of Germany | 114/203 |
| 7708497 | 8/1977 | Netherlands | 135/105 |
| 1779938 | 5/1972 | U.S.S.R. | 114/203 |
| 1581590 | 12/1980 | United Kingdom | 114/203 |

*Primary Examiner*—Joseph F. Peters, Jr.
*Assistant Examiner*—Clifford T. Bartz
*Attorney, Agent, or Firm*—Fisher, Christen & Sabol

[57] ABSTRACT

A waterproof fabric awning is tied to the hinges at the back of a boat hatch and suspended forward over the hatch. Flexible ribs form it into the shape of an arch in function but allow it to be rolled up compactly for storage.

8 Claims, 2 Drawing Sheets

FIG. 4
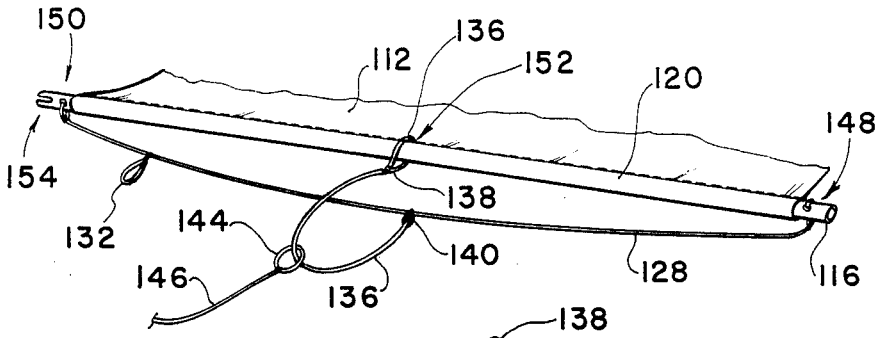
FIG. 5
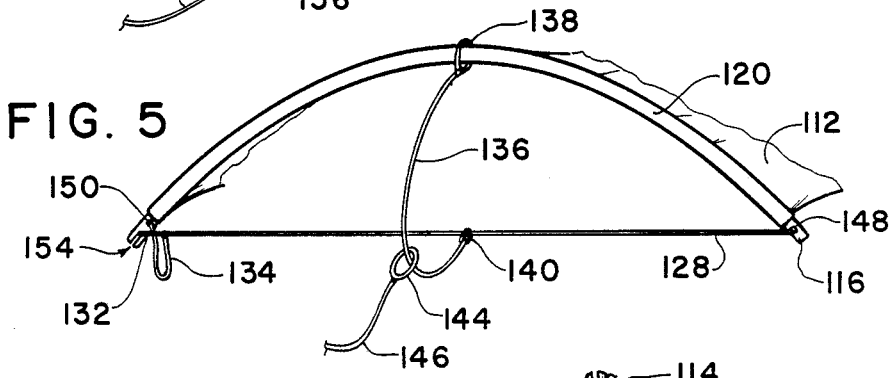
FIG. 6
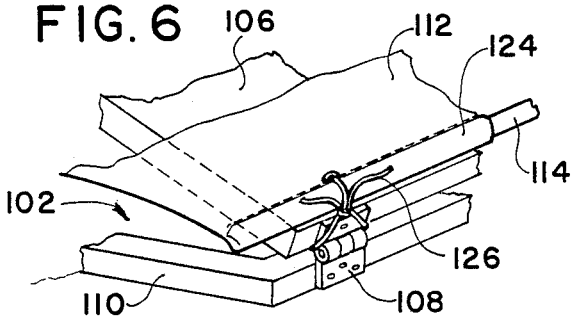
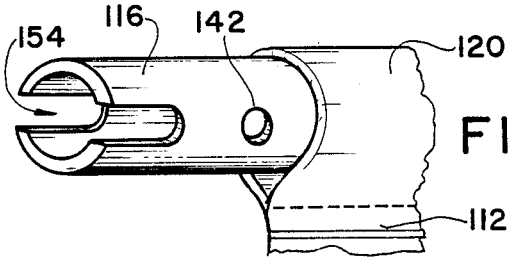
FIG. 7
FIG. 8
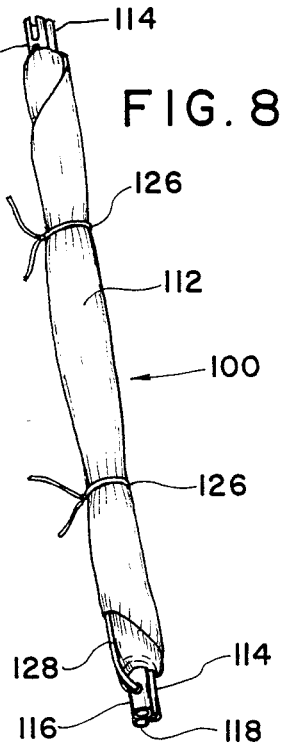

HATCH VENTILATOR AWNING FOR BOATS

FIELD OF THE INVENTION

The invention relates to devices for protecting the hatch opening from precipitation while maximizing ventilation into the boat.

BROAD DESCRIPTION OF THE INVENTION

An object of the invention is to provide means for preventing precipitation from entering the open hatch of a boat. Another object of the invention is to provide means to funnel the breeze into the hatch, thus maximizing ventilation. Other objects and advantages of the invention are set out herein or are obvious herefrom to one skilled in the art.

The objects and advantages of the invention are achieved by the hatch ventilator awning of the invention.

The invention involves a hatch ventilator awning for a boat, comprising:

(a) sheet of water-proof material, which can be positioned over a hatch opening of said boat;

(b) first attachment means comprising one end of said sheet (a), said attachment means being adapted to be attached to said boat so as to position said sheet (a) over said boat hatch opening;

(c) flexible means comprising the other end of sheet (a), said flexible means being capable of being forced into a flexed position whereby at least the portion of said sheet (a) located by said other end of sheet (a) is formed into a curve facing said boat hatch;

(d) means whereby said flexible means (c) can be forced into said flexed position;

(e) second attachment means which is attached to said means (d) and to said flexible means (c); and (f) third attachment means which is attached to said second attachment means (e) and which is adapted to be attached to said boat at a position away from said hatch.

Preferably the second attachment means (e) is attached to the central portion of the means (d) and to the central portion of the flexible means (c). Preferably the third attachment means (f) is slidably attached on the second attachment means (e). Also, preferably the third attachment means is adapted to be attached to the boat so as to place stress on the means (d) and the flexible means (c) and the sheet (a) in relation to the first attachment means (b).

A result of the invention device is that ventilation into the boat can be varied according to the comfort needs of the inhabitants without concern for precipitation. Specifically, the large area covered by the awning gathers any breeze from the front of the boat and amplifies the amount of breeze entering the fully open hatch. The boaters, at their discretion can increase or decrease the opening of the hatch, thus controlling ventilation. The hatch can be left open in the event of precipitation as the awning is waterproof and overhangs the hatch.

The device involves a piece of waterproof fabric which is suspended over the open boat hatch. The forward portion of the fabric is formed into an arch by a bow shaped rib. Depending upon size, a second bow shaped rib can be used to form an arch in the middle portion of the fabric. The back of the fabric, having a straight rib, is attached to the aft end of the hatch.

The forward and middle ribs are formed into their bowed shape by a piece of cord attached to the ends of the ribs. When relaxed, the cords allow the ribs to be straight, allowing for easy rolling up of the fabric on the ribs for storage. When pulled into tension, the cords pull the ribs into a bow, forming the functional shape.

There are three points of attachment to the boat. The straight rib in back is fixed in two places to two hinges of the hatch by cords. The forward portion is pulled forward by a single suspension line connected to both the forward rib and then tied to a point forward on the boat such as a cleat or bow pulpit. The result is that the hatch ventilator awning is suspended over the hatch.

BRIEF DESCRIPTION OF THE DRAWINGS

In the drawings:

FIG. 4 is a front view of the forward flexible rib with its bowstring in the relaxed position;

FIG. 5 is a front view of the forward flexible rib with its bowstring in tension, forming it into a bow;

FIG. 6 is a rear corner view of the tie down cord in position around a hinge of the hatch;

FIG. 7 is a view of one end of each flexible rib showing a slot for attachment of the bowstring loop as well as a hole for permanent attachment of the end of the bowstring; and FIG. 8 is a view of the device of FIG. 1 rolled up and ready for storage.

DETAILED DESCRIPTION OF THE INVENTION

Figure 1:
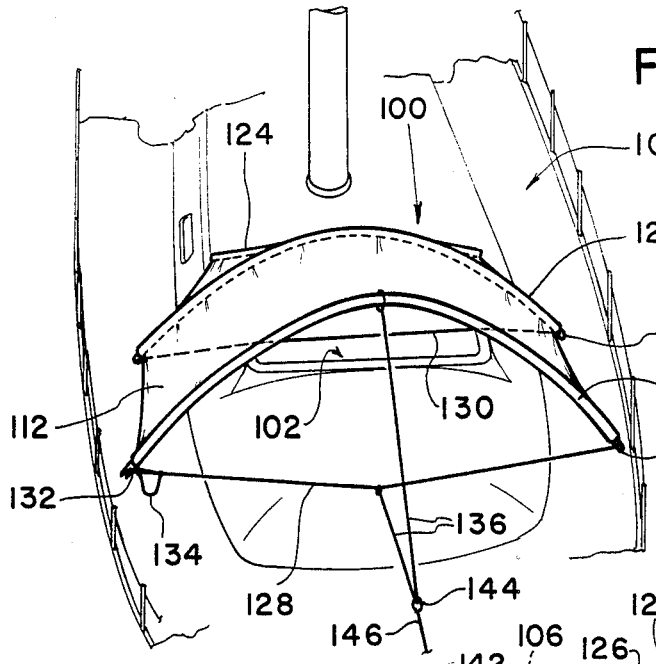
FIG. 1 is a perspective view of the hatch ventilator awning of the invention mounted on the forward hatch looking from the front of the boat toward the back of the boat.
Figure 2:
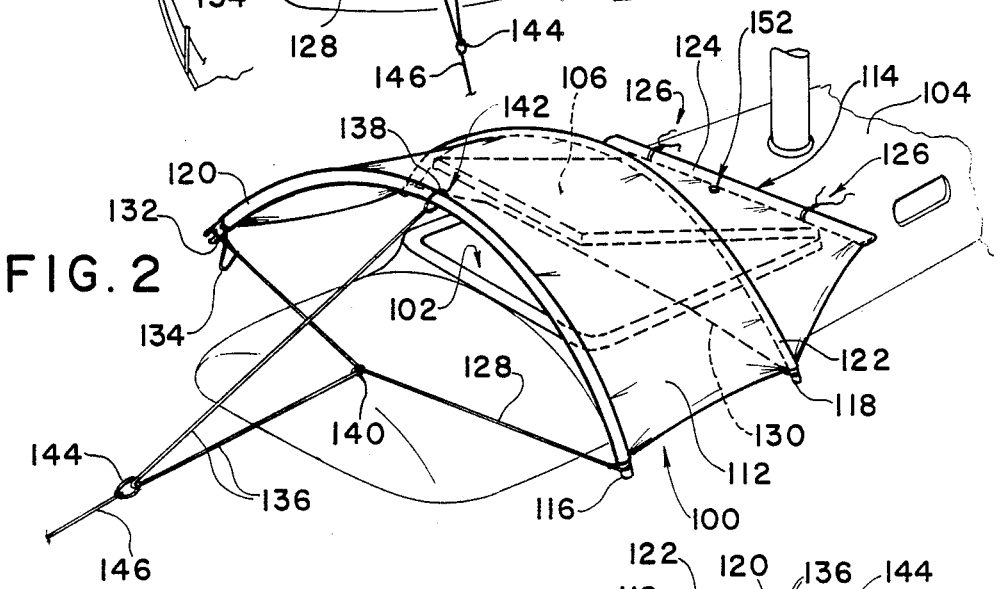
FIG. 2 is a perspective from the left front showing the device of FIG. 1 over the hatch.
Figure 3:
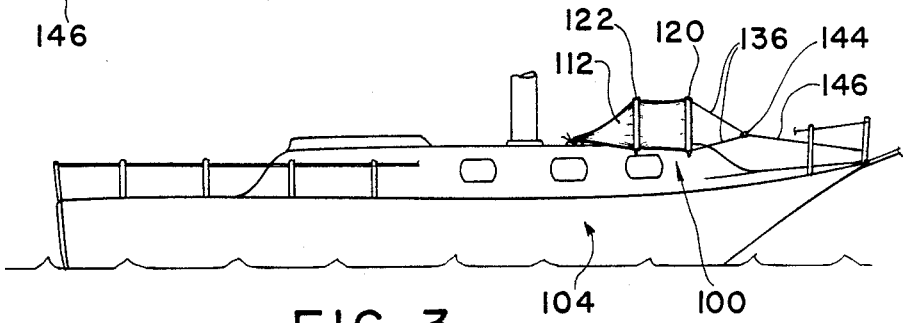
FIG. 3 is a side elevation of a sailboat with the device of FIG. 1 in place over the forward hatch.

In FIGS. 1, 2 and 3, the hatch ventilator awning 100 is shown mounted in position over the forward hatch 102 of a boat 104. The forward hatch 102 has hatch top 106, which is pivotally attached by hinges 108 to the back portion of hatch frame 110. The waterproof fabric body 112 is shown mounted and held in shape by the straight rib 114 in back and by two flexible ribs 116 and 118 which form fabric body 112 into an arch. Flexible rib 116 fits into front pocket 120 of fabric body 112. Flexible rib 118 fits into middle pocket 122 of fabric body 112. Straight rib 114 fits into back pocket 124 of fabric body 112. Flexible (straight) ribs 116 and 118 are preferably flexible (straight) plastic pipes. Straight rib 114 is preferably a non-flexible, straight, plastic pipe or wood dowel.

The two lines 126, 126 connected to straight rib 114 tie the awning down at the rear. The bowstrings 128, 130 pull the flexible ribs 116, 118 into their functional (arched) shape. (See the slack loop 134 of line 128 when loop 132 is used to arch rib 116.) Bowstring 128 (illustrative also of bowstring 130) is affixed at one end via loop 148 in hole 142 and at the other end via loop 150 in the other hole 142 in forward flexible rib 116. As detailed in FIG. 4, the connector line 136 is fixed at one end via loop 138 through a hole (152) in fabric 112 to the middle of forward flexible rib 116 and at the other end via loop 140 to the middle of the forward bowstring 128. A loop or ring 144 on the end of the suspension line 146 allows the suspension line 146 to slide on the connector line 136. Tension on the suspension line 146 transmits to the connector line 136 and the combination holds the awning 100 forward over the hatch 102. The large fabric area in the arch shape gathers the breeze, funneling it down the hatch 102 to enhance ventilation while the fabric overlap forward and to the sides of the hatch 102 prevents precipitation from entering the hatch 102. The suspension line 146 can be fastened at a higher position on the boat, raising the awning 100 to maximize ventilation or at a lower position to prevent rain entry.

When the wind is from the rear, a line may be tied through hole 152, around straight rib 114 and fastened to a postion on the boat 104 behind the hatch 102 to pull the awning 100 back and provide overlap to the rear of the hatch 102.

Operation of the flexible ribs 116 and 118 is best shown in FIGS. 4, 5 and 7. In the condition shown in FIG. 4, the flexible rib 116 is straight. The bowstring 128, 130 is attached at each end to holes 142 in each end of the flexible rib (116, 118). In FIG. 5, loop 132 has been placed into slot 154 of flexible rib 116, pulling tension on bowstring 128 and pulling the flexible rib 116 into the shape of an arch. Loops 148 and 150 are shown and their function is to attach connector line 128 to front flexible rib 116.

One of two lines 126 is shown in FIG. 6 attached around straight rib 114. Each line 126 is tied around a hatch hinge 108 to hold the awning 100 in position at the back of the hatch 102.

FIG. 7 illustrates one end of flexible rib 116 (same flexible rib 118). Hole 142 provides for permanent attachment of bowstring 128. Slot 154 allows attachment of loop 132 to pull the rib 116 into its functional shape. The other end of each flexible rib (116, 118) contains only hole 142, without slot 154.

The awning 100 is shown ready for storage in FIG. 8. The fabric body 112 has been rolled up on the now straight flexible ribs 116, 118 and tied with ties 126 which are the same ties that fasten the awning 100 to the back of the hatch 102 when in function.

What is claimed is:

1. Hatch ventilator awning for a boat, comprising:

(a) sheet of water-proof material, which can be positioned over a hatch opening of said boat;

(b) first attachment means comprising one end of said sheet (a), said attachment means being adapted to be attached to said boat so as to position said sheet (a) over said boat hatch opening;

(c) flexible means comprising the other end of sheet (a), said flexible means being capable of being forced into a flexed position whereby at least the portion of said sheet (a) located by said other end of sheet (a) is formed into a curve facing towards said boat hatch;

(d) connection means whereby said flexible means (c) can be forced into said flexed position;

(e) second attachment means which is attached to said connection means (d) and to said flexible means (c); and (f) third attachment means which is attached to said second attachment means (e) and which is adapted to be attached to said boat at a position away from said hatch.

2. The hatch ventilator awning of claim 1 wherein second attachment means (e) is attached to the central portion of said connections means (d) and to the central portion of said flexible means (c).

3. The hatch ventilator awning of claim 2 wherein said third attachment means (f) is slidably attached on said second attachment means (e).

4. The hatch ventilator awning of claim 3 wherein said third attachment means is adapted to be attached to said boat so as to place stress on said connection means (d) and said flexible means (c) and said sheet (a) in relation to said first attachment means (b).

5. The hatch ventilator awning as claimed in claim 1 wherein said sheet (a) is a waterproof fabric body having:

(i) a first pocket in the back edge portion at the one end of said sheet of said fabric body which contains a straight rib;

(ii) two holes inside of the seam of said first pocket for insertion of two lines around said straight rib for affixing the back of said fabric body to said hatch opening;

(iii) a second pocket in the front edge of said fabric body which contains a flexible rib, which allows the front portion of said fabric body to be formed into an arch; and (iv) a hole inside of the seam of said second pocket for insertion of a connector cord, which comprises said attachment means (e).

6. The hatch ventilator awning as claimed in claim 5 wherein said connection means (d) comprises a line having a loop therein near one end, and said flexible means comprising a flexible rib which, while straight in the disassembled form, shapes said forward and middle portions of said sheet (a) into a downward facing arch in the assembled form and which contains (i) a hole near each end whereby one end of said line is affixed to said flexible rib; and (ii) a mechanism such as a groove, slot or hook near the other end, to which is attached said loop.

7. The hatch ventilator awning as claimed in claim 5 wherein:

(i) there are two tie down lines, each of which is affixed to a hole in said first pocket and around said rib therein and each of which is used to attach said hatch ventilator awning to the hinges of the boat hatch;

(ii) said connection means comprises a line, each end of which is affixed to an end of said flexible means, and which has a loop in the line which fits in a groove, slot or hook near one end of said flexible means, thereby forming the front portion of said sheet (a) into a bow when the line is pulled into tension, by positioning the loop in the groove, slot or hook;

(iii) said second attachment means comprises a connector cord, one end thereof being affixed to the middle portion of said flexible means through a hole in said second pocket, and the other end thereof being affixed to a loop in the middle portion of said line (ii); and (iv) said third attachment means comprises a suspension line, one end of which contains a loop or ring which surrounds and slides on said connector (iii), and the other end of which is attached forward of the awning on the boat so as to suspend said fabric body above the boat hatch and forward thereof.

8. The hatch ventilator awning as claimed in claim 7 wherein said fabric body (a) has a third pocket in the middle portion thereof, said third pocket being generally parallel to said first and second pockets, and a second flexible means being contained in said third pocket, said second flexible means being capable of being shaped into an arch and held in the arched position by means of a second line attached to each end thereof.

* * * * *